US009409396B2

(12) United States Patent
Herrmann et al.

(10) Patent No.: US 9,409,396 B2
(45) Date of Patent: Aug. 9, 2016

(54) INK JET PRINT HEAD PROTECTIVE GUIDE SYSTEM

(71) Applicant: XEROX CORPORATION, Norwalk, CT (US)

(72) Inventors: Douglas K. Herrmann, Webster, NY (US); Jason M. LeFevre, Penfield, NY (US); Derek A. Bryl, Webster, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 14/922,782

(22) Filed: Oct. 26, 2015

(65) Prior Publication Data

US 2016/0089884 A1 Mar. 31, 2016

Related U.S. Application Data

(62) Division of application No. 14/500,453, filed on Sep. 29, 2014, now Pat. No. 9,199,466.

(51) Int. Cl.

| | |
|---|---|
| ***B41J 2/14*** | (2006.01) |
| ***B41J 2/145*** | (2006.01) |
| ***B41J 2/165*** | (2006.01) |

(52) U.S. Cl.

CPC ..... *B41J 2/145* (2013.01); *B41J 2/1433* (2013.01); *B41J 2/16508* (2013.01); *B41J 2/165* (2013.01); *B41J 2/16505* (2013.01); *B41J 2002/14443* (2013.01)

(58) Field of Classification Search

CPC .... B41J 2/165; B41J 2/16505; B41J 2/16508; B41J 2/16511; B41J 2/16585; B41J 2/155; B41J 2/1606; B41J 2002/14411

See application file for complete search history.

(56) References Cited

U.S. PATENT DOCUMENTS

| | | | | |
|---|---|---|---|---|
| 6,305,779 | B1 * | 10/2001 | Capurso | B41J 2/16505 347/33 |
| 7,328,965 | B2 | 2/2008 | Owaki | |
| 2006/0103690 | A1 | 5/2006 | Katayama | |
| 2008/0150986 | A1 | 6/2008 | Ikeda | |
| 2009/0244173 | A1 | 10/2009 | Yokouchi | |

* cited by examiner

*Primary Examiner* — Geoffrey Mruk

(74) *Attorney, Agent, or Firm* — MH2 Technology Law Group LLP

(57) ABSTRACT

A method for printing includes the use of a protective guide system that protects a print head nozzle plate from physical contact with objects such as a curled print medium. The print head nozzle plate includes a nozzle array including a plurality of nozzles arranged in a plurality of subarrays. The plurality of subarrays are spaced from each other by a plurality of intranozzle areas devoid of nozzles. The protective guide system includes a frame and a plurality of cross members aligned with the intranozzle areas between the subarrays. The protective guide system thus protects the print head nozzle plate without obstructing the ink during printing.

13 Claims, 7 Drawing Sheets

INK JET PRINT HEAD PROTECTIVE GUIDE SYSTEM

CROSS-REFERENCE TO RELATED APPLICATIONS

This application is a divisional of U.S. patent application Ser. No. 14/500,453, filed Sept. 29, 2014, now allowed, which is incorporated herein by reference in its entirety.

TECHNICAL FIELD

The present teachings relate to the field of ink jet printing devices and, more particularly, to a print head nozzle plate protection system.

BACKGROUND

Drop on demand ink jet technology is widely used in the printing industry. Printers using drop on demand ink jet print heads can include the use of thermal ink jet technology, piezoelectric technology, or electrostatic technology. Each of these technologies include the ejection of ink drops from a plurality of nozzles within a nozzle plate.

Damage to the print heads, and more particularly the nozzle plate, can result from physical contact with other objects, including the print medium receiving the ink drops. For example, a print medium such as a paper sheet or other types of porous hydrophilic substrates can curl from absorption of ambient moisture, from improper storage or loading, or from moisture incurred from marking the sheet with aqueous ink. As the curled leading edge of the print medium enters the print area, the print medium can contact and damage the nozzle plate. Depending on the printer, replacement of a damaged print head is very expensive resulting from the cost of the print head itself, downtime of the printer, and labor costs incurred during replacement and/or repair.

A structure that reduces or eliminates damage to print heads from contact with the print medium or other structure would be desirable.

SUMMARY

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

In an embodiment, a printer can include a print head comprising a nozzle plate. The nozzle plate can include a nozzle array comprising a plurality of nozzles arranged in a plurality of subarrays, and a plurality of intranozzle areas devoid of nozzles, wherein each intranozzle area is positioned between two adjacent subarrays from the plurality of subarrays. The printer can further include a print head protection guide, including a frame and a plurality of cross members attached to the frame and aligned with the plurality of intranozzle areas between each subarray.

In another embodiment, a method for operating a printer can include aligning a plurality of print head protection guide cross members with a plurality of intranozzle areas between a plurality of nozzles of a print head nozzle plate, wherein the plurality of intranozzle areas are devoid of nozzles, ejecting an ink from the plurality of nozzles onto a print medium while the plurality of print head protection guide cross members are aligned with the plurality of intranozzle areas, wherein the plurality of print head protection guide cross members protect the print head nozzle plate from physical contact with the print medium, and moving the plurality of print head protection guide cross members from a first position proximate the nozzle plate to a second position away from the nozzle plate.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

It should be noted that some details of the FIGS. have been simplified and are drawn to facilitate understanding of the present teachings rather than to maintain strict structural accuracy, detail, and scale.

DETAILED DESCRIPTION

Reference will now be made in detail to exemplary embodiments of the present teachings, examples of which are illustrated in the accompanying drawings. Wherever possible, the same reference numbers will be used throughout the drawings to refer to the same or like parts.

As used herein, unless otherwise specified, the word "printer" encompasses any apparatus that performs a print outputting function for any purpose, such as a digital copier, bookmaking machine, facsimile machine, a multi-function machine, electrostatographic device, etc. Unless otherwise specified, the word "polymer" encompasses any one of a broad range of carbon-based compounds formed from long-chain molecules including thermoset polyimides, thermoplastics, resins, polycarbonates, epoxies, and related compounds known to the art. Unless otherwise specified, a "print medium" includes any surface that receives ink during printing. The print medium may be the terminal location of the ink or an intermediate surface that is used to subsequently transfer the ink to the terminal location, such as an intermediate transfer belt or roller. The print medium may be porous, nonporous, cellulosic, polymeric, fabric, metallic, etc.

The present teachings include a protective guide system that can reduce or eliminate damage to the print head nozzle plate resulting from physical contact with a print medium or another structure. The protective guide system protects print head structures from physical contact with objects such as a print medium by providing a contact barrier that reduces the likelihood of physical contact between the nozzle plate and another object.

Figure 1:
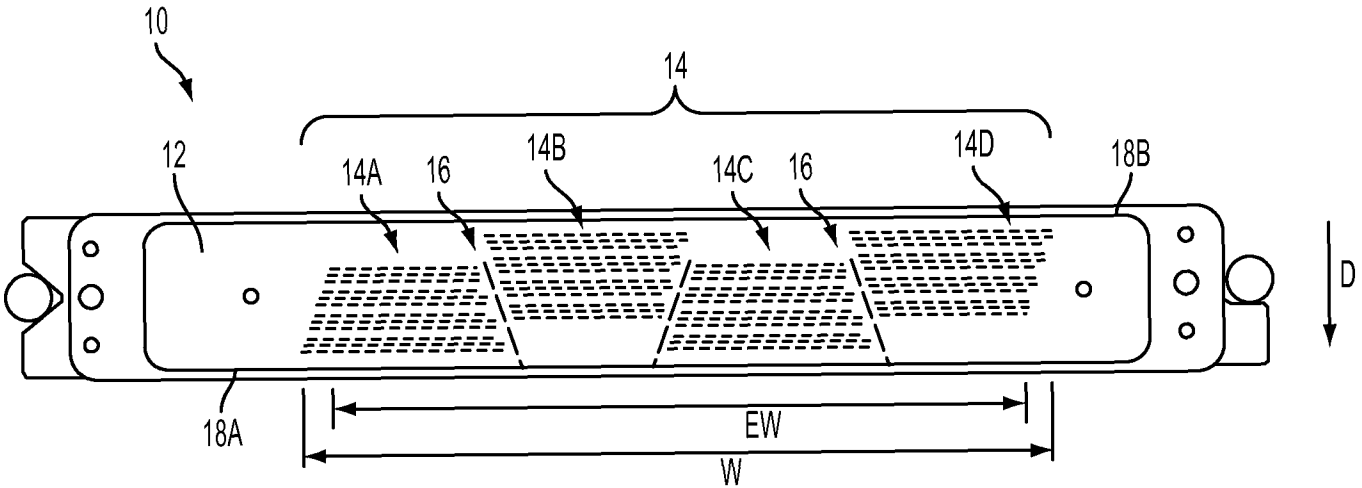
FIG. 1 is a plan view of a print head structure including a nozzle plate in accordance with an embodiment of the present teachings.

FIG. 1 is a plan view of a print head 10 including a print head nozzle plate 12 in accordance with an embodiment of the present teachings. The nozzle plate 12 includes a plurality of nozzles (i.e., a nozzle array including a plurality of nozzles) 14 through the nozzle plate 12 from an ink supply side to an ink ejection side of the nozzle plate 12. The nozzle array 14 is arranged as a plurality of nozzle subarrays 14A-14D. FIG. 1 depicts four nozzle subarrays 14A-14D for illustration, but a nozzle array 14 may include two or more subarrays of nozzles (i.e., jets or apertures).

In FIG. 1, the plurality of nozzles 14 in each subarray 14A-14D are arranged to have a perimeter shaped as an isosceles trapezoid having two sides, a longer base, and a shorter base as depicted, with each subarray 14A-14D separated from at least one adjacent subarray by an intranozzle area (i.e., an intranozzle spacing) 16. Each intranozzle area 16 is located within the boundary of the nozzle array 14 and between adjacent nozzle subarrays 14A-14D. Each intranozzle area 16 between the subarrays 14A-14D is devoid of (i.e., free from) nozzles 14. The intranozzle areas 16 between each spaced subarray 14A-14D result, in part, by forming every second subarray in an inverted orientation relative to the nozzle plate 12, and spacing each subarray 14A-14D from an adjacent subarray by a width of the intranozzle area 16. For example, as depicted in FIG. 1, the longer bases of trapezoidal-shaped subarrays 14A, 14C are located (i.e., oriented) toward a first edge 18A of the nozzle plate 12, while the longer bases of trapezoidal-shaped subarrays 14B, 14D are located toward a second edge 18B of the nozzle plate 12, where the second edge 18B is opposite the first edge 18A. As depicted by dashed lines within the intranozzle areas 16 in FIG. 1, a midline of each intranozzle area 16 between each subarray 14A-14D intersects the first edge 18A to form an acute angle, wherein the acute angle may be from about 10° to about 30°, or from about 15° to about 25°, or about 22°. This angle is also the interior acute angle formed by the longer base and each side of each trapezoidal-shaped subarrays 14A-14D. The width of each intranozzle area 16 between each subarray 14A-14D may be from about 1 mm to about 4 mm, or from about 1.5 mm to about 3.5 mm, or from about 2 mm to about 3 mm.

Providing the plurality of subarrays 14A-14D to be shaped as an isosceles trapezoid as depicted in FIG. 1 allows, for example, a lateral space provided by the intranozzle area 16 that is devoid of nozzles between each subarray 14A-14D. The angled intranozzle areas 16 allow for continuous printing across the width "W" of the nozzle array 14 as the print medium 52 (FIG. 5) passes the nozzle plate 12 in the print direction "D." The nozzle array 14 has an actual print width of "W" as depicted and defined by the outermost nozzles at either end of the nozzle array 14. However, the print width W may not allow for sufficient ink coverage at the ends of the nozzle array 14 and may result in gaps in a solid ink pattern. In other words, the ends of the nozzle array 14 will not print at the rated print resolution. The nozzle array 14 may therefore have an effective print width "EW" as depicted that allows printing a solid ink pattern at the rated resolution (for example, 600 dpi) with continuous ink coverage without gaps. For a specific printer, a nozzle plate 12 may have a print width W of from about 110 mm to about 120 mm, for example about 116 mm, and an effective print width EW of from about 100 mm to about 110 mm, for example about 108 mm, although other printers may have other print widths W, EW.

The physical gap between the nozzle plate 12 and the print medium 52 is typically minimized during printing so that any off-trajectory ink drop has minimal adverse effects on print quality. For example, as the distance between the print medium 52 and the nozzle plate 12 increases, an off-trajectory ink drop is dispensed further from its intended target location on the print medium 52. Thus spacing between the print medium 52 and the nozzle plate 12 during printing may be very small, on the order of 1 mm. Print media 52 such as paper sheets or other types of porous hydrophilic substrates can curl from absorption of ambient moisture, from improper storage or loading, or from moisture incurred from marking the print medium with aqueous ink. A curl height may be several millimeters. As a curled print medium passes by the nozzle plate during printing, the print medium 52 can strike and damage the nozzle plate 12.

Figure 2:
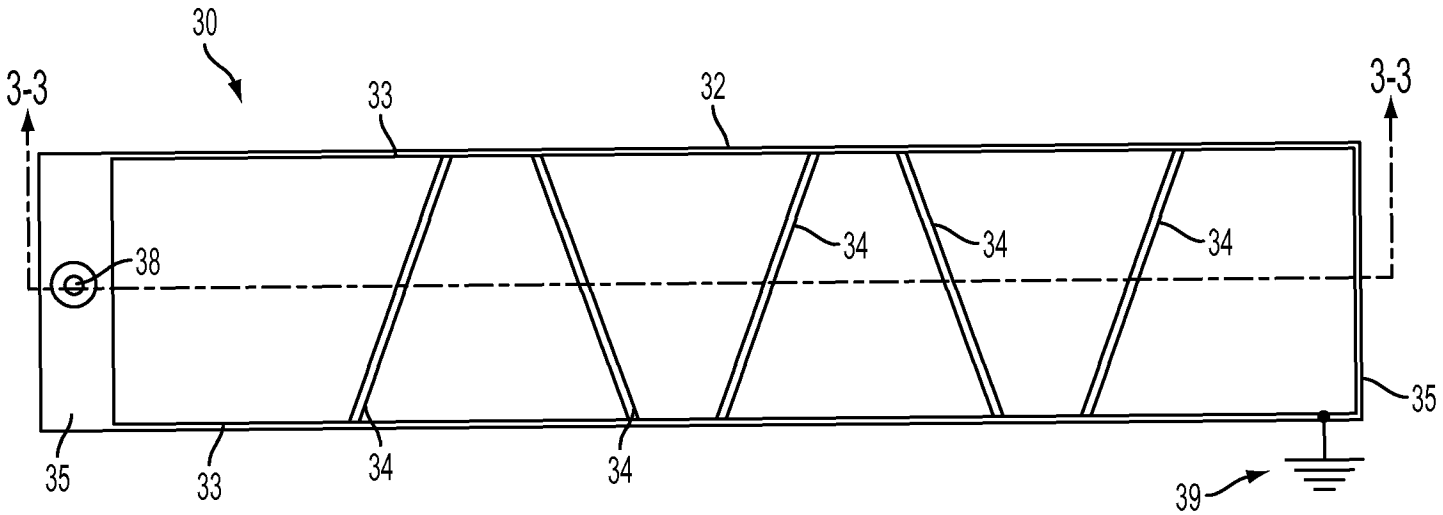
FIG. 2 is a plan view.
Figure 3:
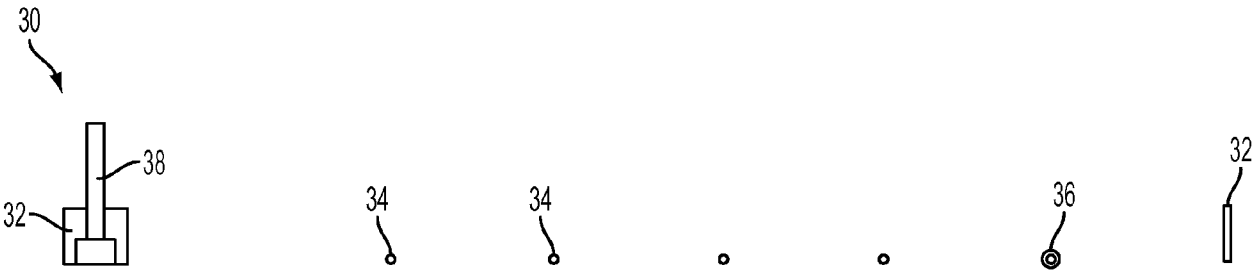
FIG. 3 is a cross section along 3-3 of FIG. 2, of a protective guide system in accordance with an embodiment of the present teachings.

FIG. 2 is a plan view, and FIG. 3 is a cross section along 3-3 of FIG. 2, depicting a protective guide system 30 in accordance with an embodiment of the present teachings. The guide system 30 can include a frame 32 and a plurality of cross members (e.g., rods or wires) 34. The frame 32 can have two longer sides 33 that intersect two shorter sides 35 to form a generally rectangular perimeter in plan view. In an embodiment, the frame 32 and plurality of cross members 34 may be manufactured from a single piece of rigid material, such as a single piece of metal or a rigid polymer using a molding process. In another embodiment, the frame 32 and each rigid cross member 34 may be manufactured separately, and the cross members 34 may be welded or brazed to the frame, or adhered to the frame 32 using an adhesive. In another embodiment, the cross members 34 can be a plurality of metal rods brazed, welded, or adhered to the frame 32. In another embodiment, the cross members 34 may be a plurality of twisted cables mounted at each end to the frame 32. In an embodiment, the cross members 34 may be formed by a single line or cable that weaves through holes in the frame 32 to provide the plurality of cross members 34. The cross members 34 may have a round cross section as depicted in FIG. 3, or they may be square, rectangular, or oval in cross section.

Additionally, the cross members 34 may optionally physically contact the nozzle plate 12 during use. Physical contact between the cross members 34 and the nozzle plate 12 may allow for a closer spacing between the nozzle plate 12 and the print medium 52 during printing. In case physical contact occurs, the cross members 34 may optionally include a protective coating 36 (one coated cross member is depicted in FIG. 3 for illustration), for example a using a polymer coating. The protective coating 36 can pad the cross members 34 to reduce or prevent wear to the nozzle plate 12 from contact with the cross members 34 during use of the protective guide system 30. The cross members 34 can also be uncoated as depicted in FIG. 3.

A width or diameter (hereinafter, collectively, diameter) of each cross member 34 is less than the width of each intranozzle area 16 between each nozzle subarray 14A-14D. Additionally, a diameter of each cross member 34 is less than the spacing between the print medium 52 and the nozzle plate 12 during printing. The width of each cross member 34 may be from about 0.2 mm to about 3.8 mm, or from about 1.25 mm to about 3.25 mm, or from about 1.75 mm to about 2.75 mm. Each cross member 34 forms an acute angle with the frame 32, which can be the same angle as the acute angle formed by the midline of each intranozzle area 16 between each subarray 14A-14D that intersects the first edge 18A. As described above, this acute angle may be from about 10° to about 30°, or from about 15° to about 25°, or about 22°. This acute angle is also the interior acute angle formed by the longer base and each side of each trapezoidal-shaped subarray.

Figure 5:
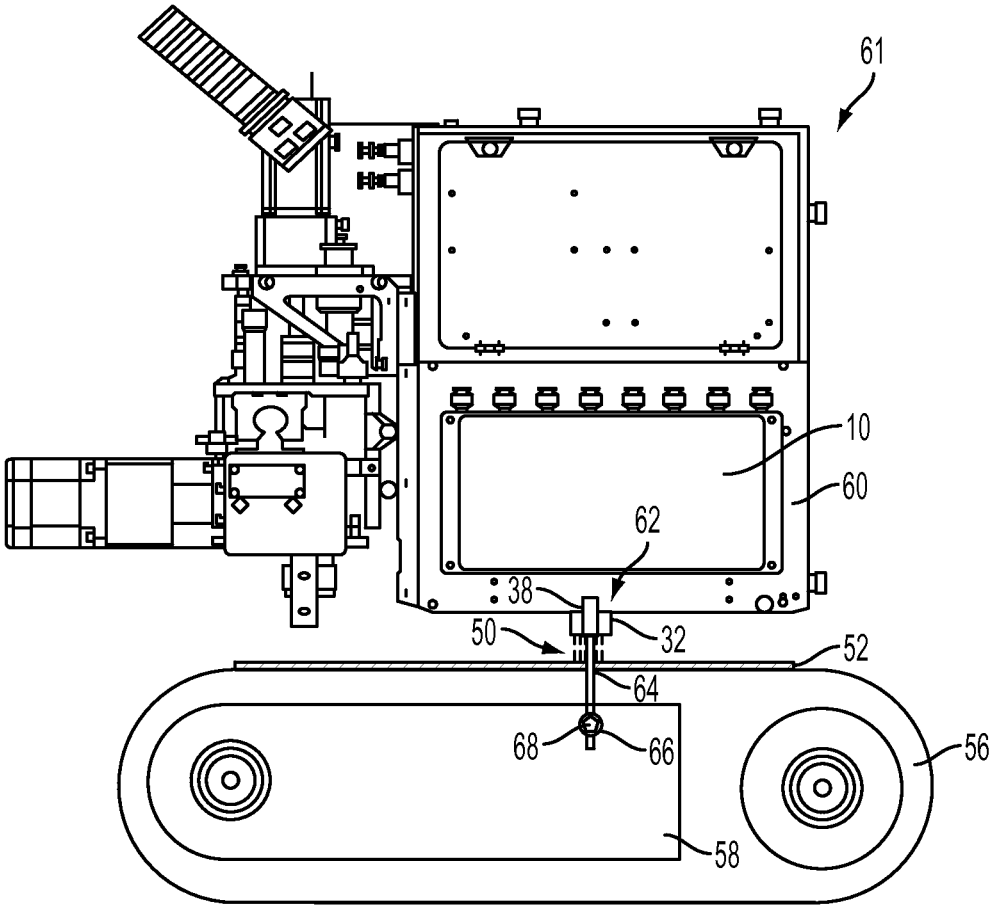
FIG. 5 is a side view.

The guide system 30 further includes an attachment system that attaches the frame 32 and cross members 34 to another location of the printer, for example, to a printer marking transport frame 58 (FIG. 5) or to a print head frame 60 (FIG. 5). As depicted in FIGS. 2 and 3, the attachment system can include at least one pin or rod 38 attached to the frame 32 and at least one hole 69 within the marking transport frame 58 or the print head frame 60 that receives the pin. During use, the attachment system may allow the frame 32 and cross members 34 to retract away from the nozzle plate 12. Retraction away from the nozzle plate 12 may be performed, for example, to clear a paper jam or to allow cleaning or other maintenance of the nozzle plate 12. Cleaning may be necessary, for example, to remove ink residues from the nozzle plate 12. Regular maintenance of the print head 10, such as cleaning of the print head face, is also routinely performed.

It will be appreciated that forming intranozzle areas 16 that are excessively wide increases the difficulty of providing complete ink coverage onto a print medium across the entire nozzle array 14, while forming intranozzle areas 16 that are too narrow results in an insufficient area to place a cross member 34 of a width that is sufficient to provide adequate protection of the nozzle plate 12.

Figure 4:
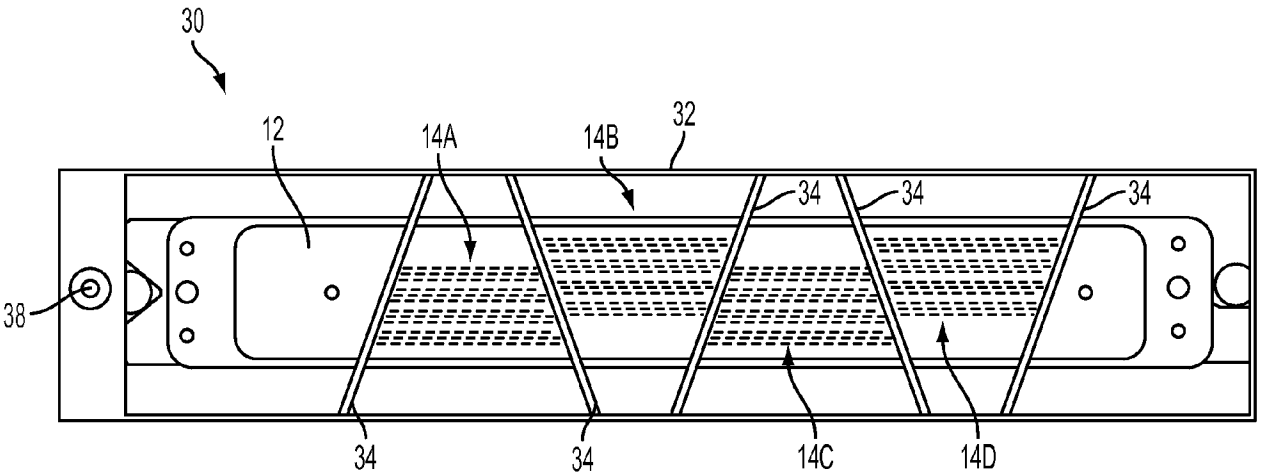
FIG. 4 is a plan view of the print head structure of FIG. 1 and the protective guide system of FIGS. 2 and 3 during use.

FIG. 4 is a plan view of the protective guide assembly 30 of FIGS. 2 and 3, and the print head 10 including the nozzle plate 12 of FIG. 1, during use. As depicted, the frame 32 can have a perimeter than extends outside a perimeter of the nozzle plate 12.

Figure 6:
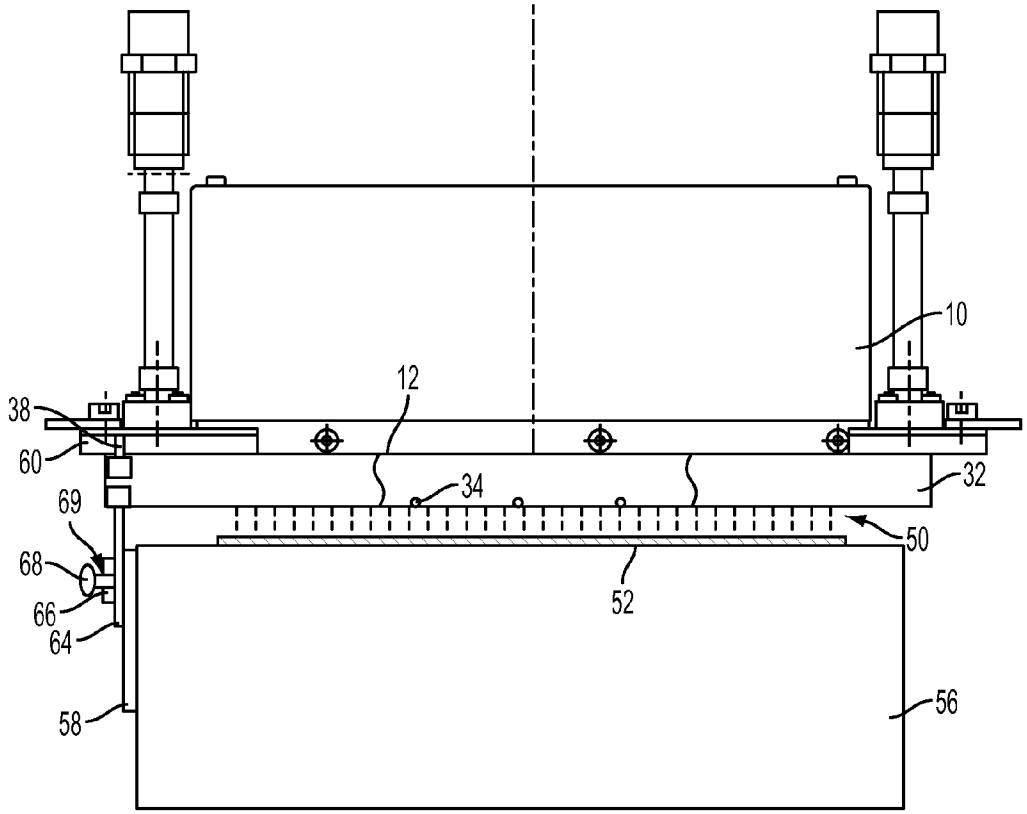
FIG. 6 is an end view, of a printer including a marking module having a plurality of print heads during printing in accordance with various embodiments of the present teachings.

FIG. 5 is a side view, and FIG. 6 is an end view, of the print head 10, nozzle plate 12, and guide assembly 30 including frame 32 and cross members 34 during printing of ink (e.g., ink drops) 50 onto a print medium 52 such as a paper sheet or transparency. In the FIG. 6 end view, the frame 32 is depicted in partial cutaway to reveal the cross members 34 and the nozzle plate 12. Ink 50 is supplied from a print head 10 or other ink feed mechanism. In an embodiment, the print medium 52 is transported to the print area using a transport mechanism 56 such as the belt depicted, or by more than one belt or a series of rollers (not depicted for simplicity). The belt 56 may be supported and actuated by a marking transport frame 58, and a mechanical assembly within the marking transport frame 58, as known in the art. FIG. 5 depicts the print medium 52 within a print medium path between the nozzle plate 12 and the belt 56. The print medium path includes the path through which the print medium is transported from a supply tray to an output tray, and includes the location between the print head 10 and the transport mechanism 56 and the print area directly between the nozzle plate 12 and the transport mechanism 56.

The print head 10 may be supported by a print head frame 60 of a marking module 61. In an embodiment, a hole 62 in the print head frame 60 receives the pin 38 that is attached to the guide frame 32 as described above. In an embodiment, the pin 38 can be fully extracted from the hole 62 in the print head frame 60 to remove the guide frame from between the belt 56 and the nozzle plate 12, thereby providing access to clean the nozzle plate 12 or to clear a paper jam.

In another embodiment, a pin 64 in the guide frame 32 is attached to the marking transport frame 58 using a marking transport frame attachment. The marking transport frame attachment can include, for example, a mount 66 having a hole 69 through which the pin 64 extends. The pin 64 may be slid through the hole in the mount 66, with the pin 64 being held in place by a fastener, for example, a friction fastener 68, such as a recessed screw or thumb screw that holds the pin 64 in place. The friction fastener 68 can be loosened so that the pin 64 is released. When in use, the friction fastener 68 is tightened and holds the frame 32 and cross members 34 close to (i.e., proximate) the nozzle plate 12 in a first position for printing. In the first position (FIGS. 5 and 6), the cross members 34 are positioned for printing directly between the nozzle plate 12 and the transport mechanism 56, close to or physically contacting the nozzle plate 12. When released, the guide frame 32 and cross members 34 may be retracted vertically away from the nozzle plate 12 and toward the transport mechanism 56 into a second position as depicted in the end view of FIG. 7. In the second position, the cross members 34 are still positioned directly between the nozzle plate 12 and the transport mechanism 56, but printing is not available when the print head protection guide 30 is in this position. After retracting the print head protection guide 30 away from the nozzle plate into the second position, the guide frame 32 and cross members 34 may be rotated horizontally away from the nozzle plate 12, the transport mechanism 56, and the print area using the pin 64 as an axis point into a third position as depicted in FIG. 8. In the third position, the cross members 34 are not positioned directly between the nozzle plate 12 and the transport mechanism 56. When the print head protection system 30 including the guide frame 32 and the cross members 34 are in the third position, the nozzle plate 12 is exposed for cleaning and/or other maintenance. Thus the print head protection guide 30, including the frame 32 and the cross members 34, are configured to be positioned for printing close to, or physically contacting, the nozzle plate in the first position, retracted away from the nozzle plate 12 into a second position, and rotated away from the nozzle plate 12 into a third position. After cleaning and/or other maintenance, the print head protection system 30 is rotatable about the pin 64 from the third position into the second position, and can be advanced toward the nozzle plate 12 into the first position for printing. During use, the protective guide system 30 is positioned between the nozzle plate 12 and the print medium path within the print area directly underneath the nozzle plate 12. As depicted in FIGS. 5 and 6, the protective guide system 30 is positioned between the nozzle plate 12 and the belt 56. The plurality of cross members 34 of the protective guide system 30 are aligned with the plurality of intranozzle areas 16 between each nozzle subarray 14A-14D so that ink can be ejected from the plurality of nozzles 14 and onto the print medium. Because the cross members 34 are aligned with the intranozzle areas 16 during printing, the cross members do not block or otherwise obstruct the ink as it is ejected from the nozzles 14, yet complete ink coverage across the print medium 52 can be maintained.

As the print medium 52 is positioned between the nozzle plate 12 and the transport medium 56 within the print area, a height of the print medium, particularly the height of a curled print medium, may be greater than the distance between the nozzle plate 12 and the location of an uncurled print medium. Without the protective guide system 30, the curled print medium can physically contact and damage the nozzle plate 12. During use, the protective guide system 30 guides and deflects the curled print medium away from the nozzle plate 12 to prevent physical contact between the print medium 52 and the nozzle plate. The face of the nozzle plate 12 including the nozzles 14 from which ink drops 50 are ejected during printing are particularly protected by the cross members 34.

The protective guide system 30 can also reduce or prevent certain types of paper jams, for example, jams resulting from lead-edge paper stubbing. The protective guide system 30 deflects any non-flat media away from the jets eliminating contact between the print media and the ink jet head surface. The guide frame remains in place allowing the guide system of wires (i.e., cross members 34) to be fixed while allowing the ink jet head 10 to move up and over to be cleaned without interfering with the wires.

A printer in accordance with an embodiment of the present teachings can be operated by aligning the plurality of print head protection guide cross members 34 within the frame 32 with the plurality of intranozzle areas 16 between the plurality of nozzles 14 of the print head nozzle plate 12. The plurality of intranozzle areas 16 are devoid of nozzles 14. Ink 50 can be ejected from the plurality of nozzles 14 onto the print medium 52 while the plurality of print head protection guide cross members 34 are aligned with the plurality of intranozzle areas 16. The plurality of print head protection guide cross members 34, which may or may not physically contact the nozzle plate 12, protect the print head nozzle plate 12 from physical contact with the print medium 52. In an embodiment, the plurality of print head protection guide cross members 34 and frame 32 may be moved from a first position proximate the nozzle plate 12 (e.g., as depicted in FIGS. 5 and 6) to a second position away from the nozzle plate 12 (e.g., as depicted in FIG. 7, or as depicted in FIG. 8).

Figure 7:
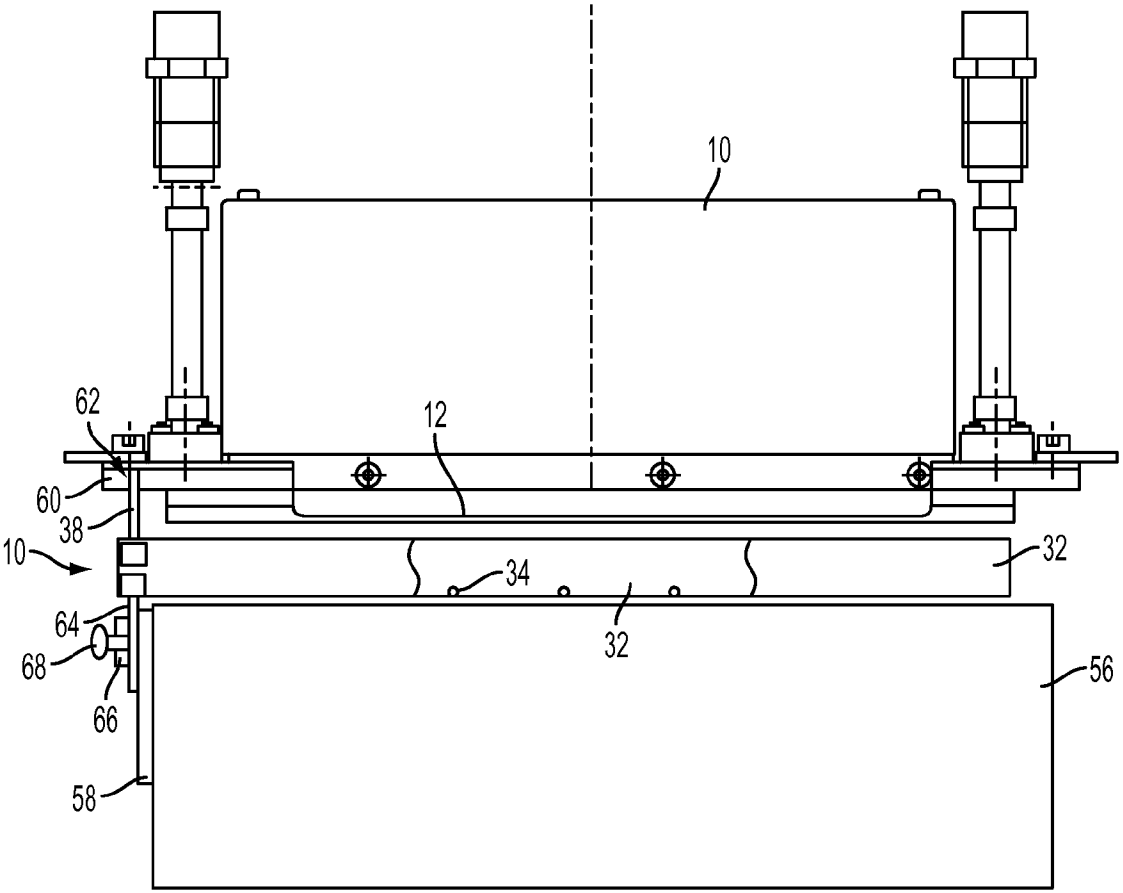
FIG. 7 is an end view of a printer, wherein the protective guide system is retracted from the nozzle plate.
Figure 8:
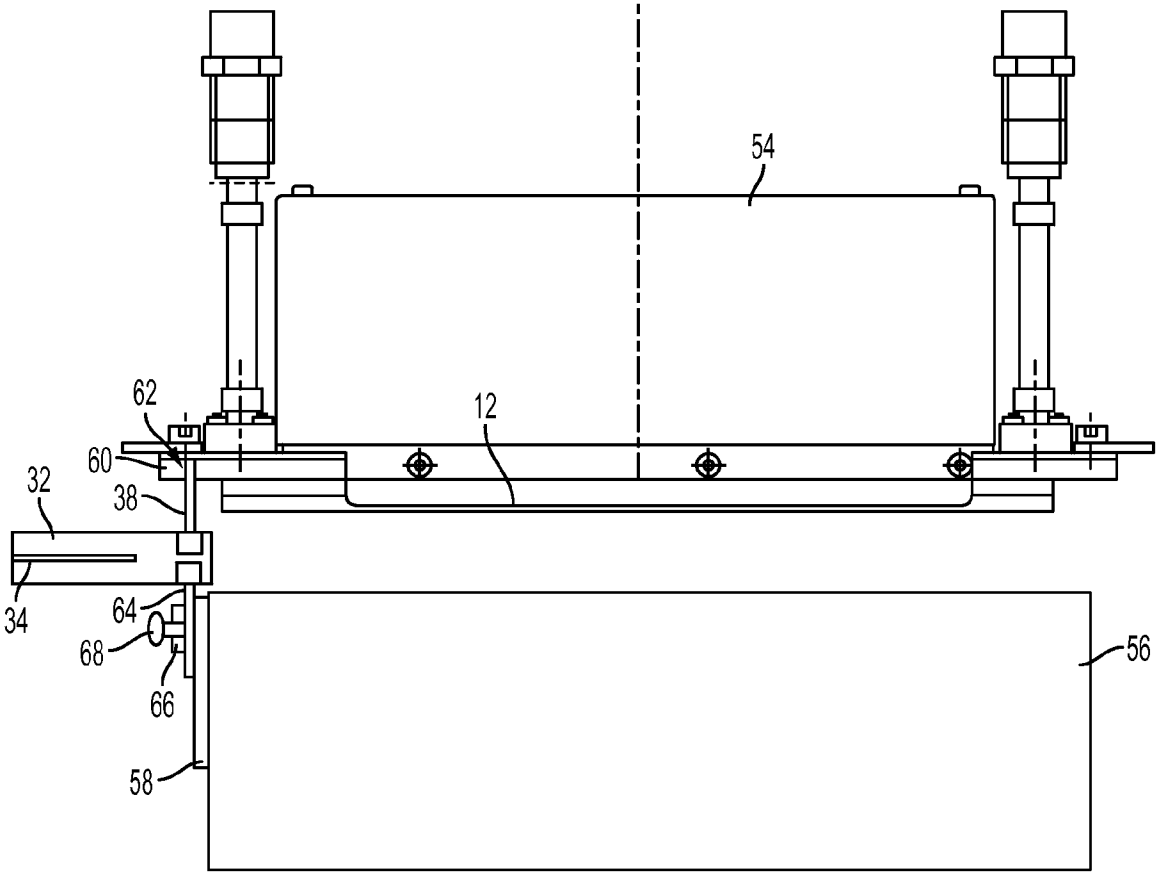
FIG. 8 is an end view of a printer assembly, wherein the protective guide system is rotated away from a print area.

In an embodiment, the plurality of print head protection guide cross members 34 and frame 32 may be retracted vertically away from the nozzle plate from a first position proximate the nozzle plate 12 (e.g., as depicted in FIGS. 5 and 6) to a second position away from the nozzle plate 12 (e.g., as depicted in FIG. 7). From the second position, the cross members 34 and frame 32 may further be moved horizontally away from the nozzle plate 12 from the second position to a third position as depicted in FIG. 8 to provide access to the nozzle plate 12.

To reduce or prevent unwanted deflection of the ink drops 50 away from the target trajectory during printing resulting from, for example, electrostatic buildup on the protective guide system 30 and the associated reduction in print quality, the frame 32 and/or cross members 34 may be grounded 39 to an electrical ground as depicted in FIG. 2. Generally, neither the frame 32 or the cross members 34 will be connected to power and thus provide a physical barrier for the nozzle plate for protection from contact with other structures rather than an electrical barrier.

It will be appreciated that the FIGS., for example FIGS. 5 and 6, may not be to scale and have been drawn to facilitate understanding of the present teachings. Additionally, a structure in accordance with the present teachings may include additional structures that have not been depicted for simplicity, while various depicted structures may be removed or modified.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. A method for operating a printer, comprising:

aligning a plurality of print head protection guide cross members with a plurality of intranozzle areas between a plurality of nozzles of a print head nozzle plate, wherein the plurality of intranozzle areas are devoid of nozzles;

ejecting an ink from the plurality of nozzles onto a print medium while the plurality of print head protection guide cross members are aligned with the plurality of intranozzle areas, wherein the plurality of print head protection guide cross members protect the print head nozzle plate from physical contact with the print medium; and moving the plurality of print head protection guide cross members from a first position proximate the print head nozzle plate to a second position away from the print head nozzle plate.

2. The method of claim 1, further comprising providing a print head comprising the print head nozzle plate and the plurality of nozzles, wherein the plurality of nozzles are provided in a plurality of subarrays with each subarray laterally separated from an adjacent subarray by one of the intranozzle areas of the plurality of intranozzle areas, and the plurality of subarrays are each provided to have a perimeter shaped as an isosceles trapezoid.

3. The method of claim 1, wherein the moving of the plurality of print head protection guide cross members from the first position to the second position retracts the plurality of print head protection guides vertically away from the print head nozzle plate, and the method further comprises moving the plurality of print head protection guides horizontally to a third position to provide access to the print head nozzle plate.

4. The method of claim 1, further comprising providing the plurality of cross members, wherein each cross member comprises a diameter of from 0.2 mm to 1.8 mm.

5. The method of claim 1, further comprising providing the plurality of nozzles in a plurality of subarrays, wherein each subarray has a perimeter shaped as an isosceles trapezoid comprising a first base, a second base that is shorter than the first base, and two sides, wherein the first base intersects each side at an angle of from 10° to 30°.

6. The method of claim 5, further comprising providing the print head nozzle plate to have a first edge and a second edge, wherein each of the plurality of intranozzle areas comprises a midline that intersects the first edge of the print head nozzle plate at an angle of from 10° to 30°.

7. The method of claim 6, further comprising providing the plurality of print head protection guide cross members within a rectangular frame having two longer sides that each intersects two shorter sides, wherein each of the plurality of cross members intersects one of the longer sides at an angle of from 10° to 30°.

8. A method for operating a printer, comprising:

aligning a plurality of print head protection guide cross members with a plurality of intranozzle areas between a plurality of nozzles on a surface of a print head nozzle plate, wherein the plurality of intranozzle areas are devoid of nozzles;

ejecting an ink from the plurality of nozzles onto a print medium while the plurality of print head protection guide cross members are aligned with the plurality of intranozzle areas, wherein the plurality of print head protection guide cross members protect the print head nozzle plate from physical contact with the print medium; and subsequent to ejecting the ink from the plurality of nozzles, moving the plurality of print head protection guide cross members from a first position proximate the surface of the print head nozzle plate that protects the surface of the print head nozzle plate from physical contact to a second position away from the surface of the print head nozzle plate to expose the surface of the print head nozzle plate to physical contact.

9. The method of claim 8, wherein the moving of the plurality of print head protection guide cross members from the first position to the second position retracts the plurality of print head protection guides vertically away from the surface of the print head nozzle plate, and the method further comprises moving the plurality of print head protection guides horizontally to a third position to provide access to the surface of the print head nozzle plate.

10. The method of claim 8, further comprising providing the plurality of cross members, wherein each cross member comprises a diameter of from 0.2 mm to 1.8 mm.

11. The method of claim 8, further comprising providing the plurality of nozzles in a plurality of subarrays, wherein each subarray has a perimeter shaped as an isosceles trapezoid comprising a first base, a second base that is shorter than the first base, and two sides, wherein the first base intersects each side at an angle of from 10°to 30°.

12. The method of claim 11, further comprising providing the print head nozzle plate to have a first edge and a second edge, wherein each of the plurality of intranozzle areas comprises a midline that intersects the first edge of the print head nozzle plate at an angle of from 10° to 30°.

13. The method of claim 12, further comprising providing the plurality of print head protection guide cross members within a rectangular frame having two longer sides that each intersects two shorter sides, wherein each of the plurality of cross members intersects one of the longer sides at an angle of from 10° to 30°.

* * * * *